US005902777A

United States Patent [19]

Hashimoto et al.

[11] Patent Number: 5,902,777

[45] Date of Patent: May 11, 1999

[54] HYDRAULIC WORKING OIL COMPOSITION

[75] Inventors: Katsumi Hashimoto; Akira Sasaki, both of Ichihara, Japan

[73] Assignee: Idemitsu Kosan Co., Ltd., Tokyo, Japan

[21] Appl. No.: 08/849,222

[22] PCT Filed: Oct. 18, 1996

[86] PCT No.: PCT/JP96/03023

§ 371 Date: Jun. 10, 1997

§ 102(e) Date: Jun. 10, 1997

[87] PCT Pub. No.: WO97/14776

PCT Pub. Date: Apr. 24, 1997

[30] Foreign Application Priority Data

Oct. 19, 1995 [JP] Japan ..... 7-270960

[51] Int. Cl.[6] ..... C10M 141/10

[52] U.S. Cl. ..... 508/438; 508/439

[58] Field of Search ..... 508/438, 439, 508/433, 551, 554, 563, 584, 485; 252/73, 785

[56] References Cited

U.S. PATENT DOCUMENTS

| | | | |
|---|---|---|---|
| 2,205,183 | 6/1940 | Woodhouse | 508/551 |
| 3,652,411 | 3/1972 | Commichau | 508/438 |
| 3,723,315 | 3/1973 | Sullivan | 508/438 |
| 3,931,022 | 1/1976 | Chesluk et al. | 252/78.5 |
| 3,970,570 | 7/1976 | Pratt et al. | 252/78.5 |
| 4,917,809 | 4/1990 | Zinke et al. | 252/78.5 |
| 5,024,775 | 6/1991 | Hanlon et al. | 508/584 |
| 5,064,546 | 11/1991 | Dasai | 508/551 |

FOREIGN PATENT DOCUMENTS

| | | |
|---|---|---|
| 0453 114 | 10/1991 | European Pat. Off. . |
| 0630 960 | 12/1994 | European Pat. Off. . |
| WO 95/02027 | 1/1995 | WIPO . |

*Primary Examiner*—Jerry D. Johnson

*Attorney, Agent, or Firm*—Oblon, Spivak, McClelland, Maier & Neustadt, P.C.

[57] ABSTRACT

There is disclosed a hydraulic working oil composition which comprises in the form of a blend, a base oil having a $C_A$ content of at most 5%; 0.01 to 5% by weight of an (A) aminic antioxidant such as 4,4'-dioctyldiphenylamine; 0.01 to 5% by weight of a (B) phenolic antioxidant such as 2,6-ditert-butyl-4-methylphenol; 0.01 to 5% by weight of a (C) phosphoric ester such as tricresyl phosphate; and 0.001 to 5% by weight of a (D) fatty acid amide such as isostearic acid triethylenetetramide and/or polyhydric alcohol ester such as sorbitan monooleate each based on the whole amount of the composition.

According to the present invention, there is provided the hydraulic working oil composition capable of effectively preventing premature deterioration of the working oil accompanying the trend towards high pressure and the sludge formation therein, being serviceable for a long period of time and at the same time, exhibiting stable working characteristics by eliminating the phenomenon of cylinder waviness, that is, a phenomenon of causing vibration and/or abnormal noise between a cylinder and a piston, between a rod and a (sealing) guide, or the like in a hydraulic working portion of hydraulic machinery.

7 Claims, No Drawings

HYDRAULIC WORKING OIL COMPOSITION

TECHNICAL FIELD

The present invention relates to a hydraulic working oil composition. More particularly, it pertains to a hydraulic working oil composition which is excellent in oxidation stability and lubricating performance under high pressure, is serviceable for a long period of time, and exhibits stable working characteristics by eliminating a phenomenon of cylinder waviness, that is, a phenomenon of causing vibration and/or abnormal noise between a cylinder and a piston, between a rod and a (sealing) guide, or the like in a hydraulic working portion of hydraulic machinery.

BACKGROUND ART

A hydraulic working oil, which is a power transmission fluid used for such actuation as power transmission, force control and force cushioning in a hydraulic system including hydraulic machinery and equipment, also fulfils the function of lubricating sliding parts.

With the recent progress towards miniaturization and high output of modern hydraulic machinery and equipment, a working pressure has increasingly been made higher, for example, the previous pressure of 14 to 20 MPa has been increased to the present pressure of 30 MPa or higher, while an oil tank has been directed to a small capacity. Such being the case, the heat load imposed upon a working oil has been made severer than ever before, thus bringing about several problems such as premature deterioration of a working oil, sludge formation therein, the phenomenon of cylinder waviness and malfunction of hydraulic machinery or equipment.

As a hydraulic working oil, there has heretofore been used a zinc alkyldithiophosphate (ZnDTP) which is imparted with both antioxidative and lubricating capabilities. However in the case of such a hydraulic working oil, the above-mentioned ZnDTP is thermally decomposed at locally hot portions that are caused by the heat of bubble compression accompanying the trend towards high pressure. The aforesaid decomposition results in several problems such as sludge formation, the resultant malfunction of hydraulic machinery and equipment and/or the generation of an abnormal odor.

Under such circumstances, an investigation has been made on the simultaneous use of the ZnDTP and a metallic detergent. Nevertheless, such combination is not satisfactory with regard to the service life thereof, and the problem of the phenomenon of cylinder waviness at the time of operation due to high pressure still remains unsolved.

DISCLOSURE OF THE INVENTION

It is the general object of the invention to provide, in such circumstances, a hydraulic working oil composition capable of effectively preventing premature deterioration of the working fluid accompanying the trend towards high pressure and the sludge formation therein, being serviceable for a long period of time and at the same time, exhibiting stable working characteristics by eliminating a phenomenon of cylinder waviness.

In view of the foregoing, intensive research and investigation were accumulated by the present inventors in order to develop a hydraulic working oil having favorable properties as mentioned hereinbefore. As a result, it has been found that the above-mentioned object can be achieved with enhanced oxidation stability and lubricating performance under high pressure by blending an aminic antioxidant, a phenolic antioxidant, a phosphoric ester and an fatty acid amide or a polyhydric alcohol-based ester with a base oil having a specific property each at a specific proportion. The present invention has been accomplished on the basis of the above-mentioned finding an information.

Specifically, the present invention provides a (1) hydraulic working oil composition which comprises in the form of a blend, a base oil having a $C_A$ content of at most 5%, 0.01 to 5% by weight of an (A) aminic antioxidant, 0.01 to 5% by weight of a (B) phenolic antioxidant, 0.01 to 5% by weight of a (C) phosphoric ester and 0.001 to 5% by weight of a (D) fatty acid amide and/or polyhydric alcohol ester each based on the whole amount of said composition.

The preferred embodiments of the present invention include:

(2) the hydraulic working oil composition according to the foregoing item (1) wherein the base oil has a kinematic viscosity at 40° C. of 2 to 500 $mm^2$/sec and a viscosity index of at least 100;

(3) the hydraulic working oil composition according to the foregoing items (1) and (2) wherein the aminic antioxidant as the component (A) is an alkylated diphenylamine having an alkyl group with 3 to 20 carbon atoms;

(4) the hydraulic working oil composition according to the foregoing items (1) to (3) wherein the phenolic antioxidant as the component (B) is a monocyclic phenolic compound;

(5) the hydraulic working oil composition according to the foregoing items (1) to (4) wherein the phosphoric ester as the component (C) is an aromatic phosphoric-ester; and (6) the hydraulic working oil composition according to the foregoing items (1) to (5) which composition is used for hydraulic machinery or equipment operated at a working pressure of 30 MPa or higher.

THE BEST MODE FOR CARRYING OUT THE INVENTION

A base oil having a $C_A$ content of at most 5% is used in the composition according to the present invention. The base oil having a $C_A$ content of more than 5% is poor in oxidation stability, especially in stability for instantaneous locally hot heat-history. From the viewpoint of such oxidation stability, the base oil has preferably a $C_A$ content of at most 3%, wherein the $C_A$ content is measured by n-d-M ring analysis method. In addition, the base oil has preferably a kinematic viscosity at 40° C. of in the range of 2 to 500 $mm^2$/sec. The base oil, when having a kinematic viscosity at 40° C. of less than 2 $mm^2$/sec, is poor in lubricating performance and besides involves a fear of causing abnormal abrasion or seisure and a strong possibility of fire. On the other hand, the base oil, when having a kinematic viscosity at 40° C. of more than 500 $mm^2$/sec, involves a fear of increasing the viscosity resistance at low temperatures, causing difficulty in suction with a pump, and thus bringing about malfunction of the machinery or equipment. Judging from the lubricating performance, hazard of fire and the viscosity resistance at low temperatures, the kinematic viscosity at 40° C. is more preferably in the range of 10 to 100 $mm^2$/sec.

It is particularly preferable in the composition according to the present invention to use a base oil satisfying not only the requirements for the content of $C_A$ and kinematic viscosity at 40° C., but also the requirement for viscosity index being at least 100 from the standpoint of the performance of the hydraulic working oil composition. The base oil, when having a viscosity index of less than 100, causes a decrease in viscosity and lowering in lubricating performance at high temperatures, whereas at low temperatures brings about an increase in viscosity and poor suction with a pump. The base oil, when having a viscosity index of 100 or more, can decrease temperature dependency of the viscosity and in particlular, extend the serviceable temperature range from low to high temperatures. The effect is remarkably observed in the base oil having a viscosity index of 110 or more. A conventional oil which is enhanced in viscosity index by incorporating a polymer therein is lowered in its viscosity index by the break of polymer chains during the service, whereas the above-mentioned base oil having an inherently high viscosity index is entirely free from such an unfavorable phenomenon as mentioned above.

As the aforesaid favorable base oil, mention can be made of a refined paraffin-base oil which is produced by subjecting a raw material such as the residue from atmospheric distillation, or the residue obtained from the desulfurizing step of a fuel oil to vacuum distillation, solvent deasphalting, dewaxing, followed by hydrorefining and hydroforming and as the case may be, solvent extraction, sulfuric acid treatment, clay treatment and the like; a paraffin-base oil with a high viscosity index; a paraffin-base oil with a high viscosity index obtained from the hydrocracking of slack wax components; and the like.

In the composition according to the present invention, there is usable a base oil of synthetic oil base other than the above-mentioned base oil of mineral base oil. Examples of the synthetic oil include polybutene and polyolefins such as an α-olefin homopolymer/copolymer, for example, an ethylene/α-olefin copolymer; a variety of esters such as polyol esters and dibasic esters; a variety of ethers and polyglycols. Of these, polyolefins and polyol esters are particularly perferable.

The above-mentioned base oil may be used alone or in combination with at least one other.

The aminic antioxidant as the component (A) in the composition according to the present invention is not specifically limited, but may be selected for use from the previously publicly known aminic antioxidants. Examples thereof include a diphenylamine compound specifically exmeplified by diphenylamine, alkylated diphenylamine having an alkyl group or groups with 3 to 20 carbon atoms such as monoctyldiphenylamine; monononyldiphenylamine; 4,4'-dibutyldiphenylamine; 4,4'-dihexyldiphenylamine; 4,4'-dioctyldiphenylamine; 4,4'-dinonyldiphenylamine; tetrabutyldiphenylamine; tetrahexyldiphenylamine; tetraoctyldiphenylamine; and tetranonyldiphenylamine, a naphthylamine compound specifically exemplified by α-naphthylamine; and phenyl-α-naphthylamine, and phenyl-α-naphthylamine substituted with an alkyl group or groups with 3 to 20 carbon atoms such as butylphenyl-α-naphthylamine; hexylphenyl-α-naphthylamine; octylphenyl-α-naphthylamine; and nonylphenyl-α-naphthylamine.

Of these, the diphenylamine compound is more effective than the naphthylamine compound with respect to instantaneous hot heat-history, and the alkylated diphenylamine having an alkyl group or groups with 3 to 20 carbon atoms, especially 4-4'-dialkyldiphenylamine having an alkyl group or groups with 3 to 20 carbon atoms is preferable.

The above-exemplified aminic antioxidant may be used alone or in combination with at least other one. The amount thereof to be blended in the composition is selected in the range of 0.01 to 5% by weight based on the whole amount of the composiiton. The antioxidant in an amount of less than 0.01% by weight involves a fear of failing to sufficiently exert the working effect of blending the same, whereas the antioxidant in an amount of more than 5% by weight can not exert the working effect in proportion to the amount blended therein and besides involves a fear of its precipitation at low temperature, thus bringing about economical disadvantatage. The amount of the aminic antioxidant to be blended therein is preferably in the range of 0.1 to 2% by weight based on the whole amount of the composition, judging from the viewpoints of its working effect, suppression of precipitation at a low temperature, economical efficiency and the like.

The phenolic antioxidant as the component (B) in the composition according to the present invention is not specifically limited, but may be selected for use from the previously publicly known phenolic antioxidant. Examples thereof include monocyclic phenols such as 2,6-di-tert-butyl-4-methylphenol; 2,6-di-tert-butyl-4-ethylphenol; 2,4,6-tri-4-tert-butylphenol; 2,6-di-tert-butyl-4-hydroxymethylphenol; 2,6-di-tert-butylphenol; 2,4-dimethyl-6-tert-butylphenol; 2,6-di-tert-butyl-4-(N,N-dimethylaminomethyl)phenol; 2,6-di-tert-amyl-4-methylphenol; n-octadecyl-3-(4'-hydroxy-3',5'-di-tert-butylphenyl)propionate and polycyclic phenols such as 4,4'-methylenebis(2,6-di-tert-butylphenol); 4,4'-isopropylidenebis(2,6-di-tert-butylphenol); 2,2'-methylenebis(4-methyl-6-tert-butylphenol); 4,4'-bis(2,6-di-tert-butylphenol); 4,4'-bis(2-methyl-6-tert-butylphenol); 2,2'-methylenebis(4-ethyl-6-tert-butylphenol); 4,4'-butylidenebis(3-methyl-6-tert-butylphenol); 2,2'-thiobis(4-methyl-6-tert-butylphenol); 4,4'-thiobis(3-methyl-6-tertbutylphenol).

Of these, the monocyclic phenols are preferable because of their high effectiveness for instantaneous hot heat-history under high pressure.

The above-exemplified phenolic antioxidant may be used alone or in combination with at least other one. The amount thereof to be blended in the composition is selected in the range of 0.01 to 5% by weight based on the whole amount of the composition. The antioxidant in an amount of less than 0.01 by weight involves a fear of failing to sufficiently exert the working effect of blending the same, whereas the antioxidant in an amount of more than 5% by weight can not exert the working effect in proportion to the amount blended therein and besides involves a fear of its precipitation at a low temperature, thus bringing about economical disadvantage. The amount of the phenolic antioxidant to be blended therein is preferably in the range of 0.1 to 2% by weight based on the whole amount of the composition, judging from the viewpoints of its working effect, suppression of precipitation at a low temperature, economical efficiency and the like.

It is necessary in the present invention to combinationally use the above-mentioned aminic antioxidant and phenolic antioxidant. The combinational use thereof conspicuously enhances instantaneous heat stability under high pressure and high temperature. Preferably the ratio of the aminic antioxidant to the phenolic antioxidant each to be used in the composition is suitably selected in the range of from 1:9 to 9:1 by weight.

A phosphoric ester is used as the component (C) in the composition according to the present invenion. The phosphoric ester, which is used for the purpose of enhancing the lubricating performance of the composition, is not specifically limited in its kind, but may be selected for use from the publicly known phosphoric esters which have heretofore been used as an extreme pressure agent or the like. Examples thereof include aliphatic phosphoric esters having an alkyl group or an alkenyl group each with 3 to 30 carbon atoms such as triisopropyl phosphate, tributyl phosphate, trihexyl phosphate, tri-2-ethylhexyl phosphate, trilauryl phosphate, tristearyl phosphate and trioleyl phosphate, an amine salt of any of these and aromatic phosphoric esters having an aryl group with 6 to 30 carbon atoms such as triphenyl phosphate, tricresyl phosphate and trixylenyl phosphate.

Of these, the aromatic phosphoric esters are preferable because of their superiority in heat stability at high temperatures, wear-resistance effect and the like.

The above-exemplified phosphoric ester may be used alone or in combination with at least other one. The amount thereof to be blended in the composition is selected in the range of 0.01 to 5% by weight based on the whole amount of the composition. The phosphoric ester in an amount of less than 0.01% by weight involves a fear of failing to sufficiently exert the working effect such as seizure prevention and wear prevention, whereas the phosphoric ester in an amount of more than 5% by weight can not exert the working effect in proportion to the amount blended therein, thus bringing about economical disadvantage. The amount of the phosphoric ester to be blended therein is preferably in the range of 0.1 to 2% by weight based on the whole amount of the composition, judging from the viewpoints of its working effect, such as seizure prevention and wear prevention, economical efficiency and the like.

A fatty acid amide and/or a polyhydric alcohol ester are used as the component (D) in the composition according to the present invention. The component (D) functions mainly for preventing the phenomenon of cylinder waviness. Examples of the fatty acid amide as the component (D) include a reaction product of a saturated or unsaturated fatty acid each having 1 to 24 carbon atoms and an aliphatic amine, an aromatic amine or a polyalkylene-polyamine such as isostearic acid triethylenetetramide, isostearic acid tetraethylenepentamide, oleic acid diethylenetriamide and oleic acid diethanolamide. On the other hand, examples of the polyhydric alcohol ester include a wholly or partially esterified product from a saturated or unsaturated fatty acid each having 1 to 24 carbon atoms and a polyhydric alcohol such as neopentyl glycol, trimethylolpropane, pentaerythritol, dipentaerythritol, sorbitan, sorbitol and glycerol, which ester is specifically exemplified by trimethylolpropane monooleate, trimethylolpropane dioleate, pentaerythritol monooleate, pentaerythritol tetraoleate, oleic acid monoglyceride, sorbitan monooleate, sorbitan sesquioleate.

As the component (D) in the composition of the present invention, the above-mentioned fatty acid amide may be used alone or in combination with at least one other; likewise the forecited polyhydric alcohol ester may be used alone or in combination with at least one other; and moreover at least one from among the fatty acid amides may be used in combination with at least one from among the polyhydric alcohol esters.

The amount of the component (D) to be blended in the composition is selected in the range of 0.001 to 5% by weight based on the whole amount of the composition. The component (D) in an amount of less than 0.001% by weight involves a fear of failing to sufficiently exhibit the working effect on the prevention of the phenomenon of cylinder waviness, whereas the component (D) in an amount of more than 5% by weight can not exhibit the working effect in proportion to the amount blended and besides leads to lowered oxidation stability, thus bringing about economical disadvantage. The amount of the component (D) to be blended therein is preferably in the range of 0.01 to 2% by weight based on the whole amount of the composition, judging from the standpoints of its working effect on the prevention of the phenomenon of cylinder waviness, oxidation stability, economical efficiency and the like. In addition, it is preferable to combinationally use the fatty acid amide and the polyhydric alcohol ester with regard to the prevention of the phenomenon of cylinder waviness. Preferably in this case, the ratio of the fatty acid amide to the polyhydric alcohol ester each to be used in the composition is suitably selected in the range of from 5:95 to 95:5 by weight.

Inasmuch as the object of the present invention is not impaired, the hydraulic working oil composition of the present invention may be blended as necessary, with an other additive, for example, a viscosity index improver such as a polymethacrylate and an α-olefin copolymer; a pour point depressant such as a polymethacrylate and a condensation reaction product of a chlorinated paraffin and naphthalene; an oiliness agent such as various fatty acids, alcohols and esters; a metallic detergent such as a sulfonate, phenate, phosphonate, salicylate or the like of an alkali metal or an alkaline earth metal; an ashless dispersant such as succinic acid imide, boron-containing succinic acid imide, benzylamine and boron-containing benzylamine; an extreme pressure agent such as sulfurized fat and oil, polysulfide, alkylphosphoric ester amine salt and chlorinated paraffin; a rust preventive such as alkenylsuccinic acid ester and sulfonate; a metal deactivator such as benzotriazole derivatives and thiadiazole derivatives; and an anti-foaming agent such as silicone oil, polyacrylate and organofluorine compound.

The blending amount of any of the above-mentioned various additives is in the range of 0.01 to 5%, preferably 0.01 to 2% by weight usually based on the whole amount of the composition.

The hydraulic working oil composiiton according to the present invention is excellent in oxidation stability and lubricating performance under high pressure, and is suitably used in hydraulic machinery and equipment that are operated at a working pressure of 30 MPa or higher. The above composition is capable of effectively preventing premature deterioration of the working oil accompanying the trend towards high pressure and the sludge formation therein, being serviceable for a long period of time and at the same time, exhibiting stable working characteristics by eliminating the phenomenon of cylinder waviness.

In the following, the present invention will be described in more detail with reference to working examples, which however, shall not limit the present invention thereto.

EXAMPLES 1 TO 4 AND COMPARATIVE EXAMPLES 1 TO 5

The base oils that were used therein were Base oil I to III each having the following properties.

Base oil I: Hydroformed oil, having a kinematic viscosity at 40° C. of 46 $mm^2$/sec, a viscosity index of 120 and a $C_A$ content of 0.1%

Base oil II: Hydrofinished oil having a kinematic viscosity at 40° C. of 46 $mm^2$/sec, a viscosity index of 105 and a $C_A$ content of 2.5%

Base oil III: Solvent-refined oil having a kinematic viscosity at 40° C. of 46 $mm^2$/sec, a viscosity index of 98 and a $C_A$ content of 7.0%

There were prepared hydraulic working oils each having the chemical composition as given in Table 1, and evaluations were made of the performances of each of the base oils by the methods as described hereunder. The results are given in Table 1.

<Evaluation of performances>

(1) Test for heat stability under high pressure

Local heat-history was imposed on the hydraulic working oil in a tank in a hydraulic circuit by the use of a high pressure pump by blowing air into the oil in the tank to form air bubbles, and instantaneously raising the pressure of the bubbles-containing oil up to 35 MPa to generate heat of compression for imposing local heat-history. Then an evaluation was made of the heat stability under high pressure of the working oil by measuring the amount of the sludge (millipore value) in the oil which had been formed during 720 hours.

(2) Test for the wear of pump

A measurement was made of the wear losses of the vane and cam ring housed in a vane pump (produced by Vickers Co., Ltd under the trade name V-104C) which had been operated at 14 MPa for a period of 250 hours.

(3) Test for cylinder waviness characteristics

A cylinder packig material was made into a semi-spherical form and underwent reciprocating motion on a chromium-plated steel sheet in the presence of 25 mg of the working oil under a load of 5 to 20 newton (N), during which period of time an observation was made of the variation state of the frictional force to judge whether a vaviness phenomenon occcurred or not.

TABLE 1-1

| | | | Examples | | | |
|---|---|---|---|---|---|---|
| | | | 1 | 2 | 3 | 4 |
| Hydraulic working oil (% by weight) | Base oil | Kind | I | I | I | II |
| | | Content | 95.8 | 96.3 | 96.3 | 95.8 |
| | (A) | Aminic antioxidant | 1.0 | 1.0 | 1.0 | 1.0 |
| | (B) | Phenolic antioxidant | 1.0 | 1.0 | 1.0 | 1.0 |
| | (C) | Phosphoric ester | 1.0 | 1.0 | 1.0 | 1.0 |
| | (D) | Fatty acid amide | 0.5 | — | 0.5 | 0.5 |
| | | Polyhydric alcohol ester | 0.5 | 0.5 | — | 0.5 |
| | Miscellaneous | | 0.2 | 0.2 | 0.2 | 0.2 |
| Performance evaluation | Test for heat stability under high pressure [sludge amount] (mg/100 mL) | | 1 | 1 | 1 | 4 |
| | test for wear of pump [wear loss] (mg) | | 3 | 4 | 4 | 5 |
| | Test for cylinder waviness characteristics [occurrence of cylinder waviness] | | no | no | no | no |

the cylinder waviness characteristics, the combinational use of the both is furthermore effective from the overall viewpoint. The performance results in Example 4, in which was used the base oil having a $C_A$ content of 2.5%, are relatively good with respect to the heat stability under high pressure. In Comparative Examples 1 to 5, unfavorable result is recognized in any of the characteristics including the heat stability under high pressure, the wear resistance of the pump and the cylinder waviness resistance.

Comparative Example 6

The procedures in the foregoing examples were repeated to evaluate the performance results except that there was used a ZnDTP-based wear resistant working fluid available on the market. The performance results revealed an amount of formed sludge of 300 mg/100 mL in the test for the heat stability under high pressure, a wear loss of 5 mg in the test for the wear of pump and confirmed waviness phenomenon in the test for the cylinder waviness characteristics. It is understood from the above-mentioned results that the ZnDTP as the working oil is thermally decomposed to form a particularly large amount of sludge in the test for the heat stability under high pressure and that the phenomenon of cylinder waviness remains unsettled.

INDUSTRIAL APPLICABILITY

The hydraulic working oil composition according to the present invention is excellent in oxidation stability and lubricating performance under high pressure. It is capable of effectively preventing premature deterioration of the work-

TABLE 1-2

| | | | Comparative Examples | | | | |
|---|---|---|---|---|---|---|---|
| | | | 1 | 2 | 3 | 4 | 5 |
| Hydraulic working oil (% by weight) | Base oil | Kind | III | I | I | I | I |
| | | Content | 95.8 | 96.8 | 96.8 | 96.8 | 96.8 |
| | (A) | Aminic antioxidant | 1.0 | — | 1.0 | 1.0 | 1.0 |
| | (B) | Phenolic antioxidant | 1.0 | 1.0 | — | 1.0 | 1.0 |
| | (C) | Phosphoric ester | 1.0 | 1.0 | 1.0 | — | 1.0 |
| | (D) | Fatty acid amide | 0.5 | 0.5 | 0.5 | 0.5 | — |
| | | Polyhydric alcohol ester | 0.5 | 0.5 | 0.5 | 0.5 | — |
| | Miscellaneous | | 0.2 | 0.2 | 0.2 | 0.2 | 0.2 |
| Performance evaluation | Test for heat stability under high pressure [sludge amount] (mg/100 mL) | | 50 | 20 | 30 | 1 | 1 |
| | test for wear of pump [wear loss] (mg) | | 6 | 3 | 3 | 500 | 4 |
| | Test for cylinder waviness characteristics [occurrence of cylinder waviness] | | no | no | no | no | yes |

Remarks:
Aminic antioxidant: 4,4'-dioctyldiphenylamine
Phenolic antioxidant: 2,6-di-tert-butyl-4-methylphenol
Phosphoric ester: tricresyl phosphate
Fatty acid amide: isostearic acid triethylenetetramide
Polyhydric alcohol ester: sorbitan monooleate
miscellaneous: rust preventive, metal deactivator, viscosity index improver, ashless dispersant, and the like agent The following can be seen from Table 1. That is to say, the performance results in Example 1, as compared with those in Comparative Examples 1, 2 and 3, are excellent in the heat stability under high pressure (less amount of sludge) and also satisfactory in the wear resistance of the pump as well as in the cylinder waviness resistance characteristics. The performance results in Example 2 and 3 demonstrate that although the use of either of the fatty acid amide and the polyhydric alcohol ester exhibits good result with regard to ing oil accompanying the trend towards high pressure as well as the sludge formation therein, being serviceable for a long period of time and at the same time, exhibiting stable working characteristics by eliminating the phenomenon of cylinder waviness.

Accordingly, the hydraulic working oil composition according to the present invention is favorably used as the working oil for hydraulic machinery and equipment in construction machinery, general industrial machinery, water sluices, hydroelectric powder stations, etc.

We claim:

1. A hydraulic working oil composition which comprises in the form of a blend, a base oil having a $C_A$ content of at most 5%, 0.01 to 5% by weight of an (A) aminic antioxidant, 0.01 to 5% by weight of a (B) phenolic antioxidant, 0.01 to 5% by weight of a (C) phosphoric ester and 0.001 to 5% by weight of a (D) fatty acid amide and/or polyhydric alcohol ester each based on the whole amount of said composition.

2. The hydraulic working oil composition according to claim 1 wherein the base oil has a kinematic viscosity at 40° C. of 2 to 500 $mm^2$/sec and a viscosity index of at least 100.

3. The hydraulic working oil composition according to claim 1 wherein the aminic antioxidant as the component (A) is an alkylated diphenylamine having an alkyl group with 3 to 20 carbon atoms.

4. The hydraulic working oil composition according to claim 1 wherein the phenolic antioxidant as the component (B) is a monocyclic phenolic compound.

5. The hydraulic working oil composition according to claim 1 wherein the phosphoric ester as the component (C) is an aromatic phosphoric-ester.

6. A method comprising operating hydraulic machinery or equipment at a working pressure of 30 MPa or higher with the hydraulic working oil composition according to claim 1.

7. The hydraulic working oil composition according to claim 1 wherein at least one additive other than the components (A), (B), (C) and (D) is blended in said composition in an amount of 0.01 to 5% by weight based on the whole amount of said composition.

* * * * *